US012139907B2

(12) United States Patent
Schieberl

(10) Patent No.: US 12,139,907 B2
(45) Date of Patent: Nov. 12, 2024

(54) PLASTIC BUILDING BLOCKS

(71) Applicant: Daniel Schieberl, Santa Rosa, CA (US)

(72) Inventor: Daniel Schieberl, Santa Rosa, CA (US)

(73) Assignee: ECO Snap Blocks, INC., Santa Rosa, CA (US)

( * ) Notice: Subject to any disclaimer, the term of this patent is extended or adjusted under 35 U.S.C. 154(b) by 391 days.

(21) Appl. No.: 17/854,644

(22) Filed: Jun. 30, 2022

(65) Prior Publication Data

US 2024/0003132 A1 Jan. 4, 2024

(51) Int. Cl.

| | |
|---|---|
| ***E04B 2/18*** | (2006.01) |
| ***E04B 2/02*** | (2006.01) |
| ***E04C 1/39*** | (2006.01) |

(52) U.S. Cl.

CPC ..... *E04B 2/18* (2013.01); *E04C 1/397* (2013.01); *E04B 2002/0213* (2013.01); *E04B 2002/0243* (2013.01); *E04B 2002/0263* (2013.01)

(58) Field of Classification Search

CPC ..... E04B 2/18; E04B 2002/0213; E04B 2002/0243; E04B 2002/0263; E04C 1/397

See application file for complete search history.

(56) References Cited

U.S. PATENT DOCUMENTS 5,107,653 A * 4/1992 Lewis ..... E04B 2/22 52/574
6,050,044 A * 4/2000 McIntosh ..... A63H 33/082 446/124
10,787,810 B2 * 9/2020 Bergollo ..... E04B 2/18
11,959,274 B2 * 4/2024 Bowers ..... B29B 17/04
12,037,786 B2 * 7/2024 Frederico ..... E04B 2/18
2005/0102950 A1 * 5/2005 Knudson ..... E02D 29/025 52/596
2005/0129468 A1 * 6/2005 Knudson ..... E02D 29/025 405/262
2013/0205705 A1 * 8/2013 Bilka ..... E04B 2/08 52/745.1

(Continued)

FOREIGN PATENT DOCUMENTS

AU 2020230258 A1 * 4/2021
EP 3456894 A1 * 3/2019 ..... E04B 2/18

(Continued)

*Primary Examiner* — Rodney Mintz

(74) *Attorney, Agent, or Firm* — My Patent Guys; Christopher Pilling

(57) ABSTRACT

A modular plastic building block for constructing a continuous wall of a structure is provided. The modular block has body that is rectangular or L-shaped depending on the position of the block within the desired structure. Each end of the modular block has a connecting member, either a male or female connecting member configured to connect to a respective female or male connecting member of an adjacent modular block. The modular block includes a pair of locking channels having at least one locking groove enabling a user to lock adjacent modular blocks vertically using a locking member. The modular plastic building block is designed for inexpensive building construction, while still providing efficient insulation and a sturdy base due to the density of plastic as the structure is mostly solid. A conduit may be provided to allow for electrical and plumbing connections within the blocks. In some instances, recycled plastic is used.

16 Claims, 6 Drawing Sheets

(56) References Cited

U.S. PATENT DOCUMENTS

| | | | | |
|---|---|---|---|---|
| 2016/0123004 | A1* | 5/2016 | Lightfoot | E04B 2/02 52/286 |
| 2019/0383004 | A1* | 12/2019 | Waters | E04B 2/18 |
| 2020/0217066 | A1* | 7/2020 | Bergollo | E04B 2/08 |
| 2022/0064941 | A1* | 3/2022 | Bowers | E04B 2/18 |
| 2022/0136238 | A1* | 5/2022 | Felton | E04B 2/16 52/596 |
| 2023/0160199 | A1* | 5/2023 | Bowers | B29B 17/0026 52/300 |
| 2023/0287679 | A1* | 9/2023 | Felton | E04B 2/08 |
| 2024/0018776 | A1* | 1/2024 | Bell | E04B 2/46 |
| 2024/0084586 | A1* | 3/2024 | Frederico | E04B 2/18 |
| 2024/0218658 | A1* | 7/2024 | Schieberl | E04B 2/24 |

FOREIGN PATENT DOCUMENTS

| | | | | |
|---|---|---|---|---|
| WO | WO-2012056394 | A1 * | 5/2012 | E04C 1/40 |
| WO | WO-2019227181 | A1 * | 12/2019 | E04B 2/18 |

* cited by examiner

PLASTIC BUILDING BLOCKS

CROSS-REFERENCE TO RELATED APPLICATIONS

N/A

BACKGROUND OF THE INVENTION

1. Field of the Invention

The present invention relates generally to building materials and more particularly to plastic building blocks.

2. Description of Related Art

With the rising costs of building materials, the present invention offers a solution, providing easy to assemble, inexpensive modular blocks comprised of sustainable materials that combine to form sturdy, dependable walls for the use of building structures.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide a sustainable building block constructed of plastic. It is another object of the present invention to provide building blocks constructed of recycled plastic. It is another object of the present to provide a lockable building block configured to lock to an adjacent block in a vertical position. It is yet another object of the invention to provide a sturdy block that can form the exterior and interior surfaces of the building. It is yet another object of the invention to provide pathways for electrical and plumbing connections.

In order to do so, a plastic building block is provided, comprising a rectangular body having a top surface, a bottom surface, a left side, a right side, a front surface, and a rear surface; a male connecting member positioned on the left side; a female connecting member positioned on the right side; at least one locking channel extending entirely through the rectangular body from the top surface to the bottom surface; a locking groove positioned in the at least one locking channel, wherein the locking groove is configured to receive a portion of a locking member; and, the plastic building block is configured to join and connect with an adjacent plastic building block, wherein the adjacent plastic building block is configured to connect to the left side or right side via the male or female connection respectively, or alternatively above or below the plastic building block via the locking member.

In one embodiment, the male connecting member extends entirely from the top surface to the bottom surface. In one embodiment, the female connecting member extends entirely from the top surface to the bottom surface. In one embodiment, the male connecting member is a cylindrical protrusion. In another embodiment, the female connecting member is a cylindrical groove configured to match the size and shape of the cylindrical protrusion. In another embodiment, a conduit extending entirely through the rectangular body from the top surface to the bottom surface is provided, wherein the conduit is configured to enable electrical and plumbing connections to pass through the rectangular body. In one embodiment, the top surface and the bottom surface is sloped from the rear side to the front side, wherein the sloped top surface is to facilitate water runoff. In yet another embodiment, the front surface or rear surface includes an additional male or female connecting member configured to allow the adjacent plastic building block to connect perpendicularly to the rectangular body. In one embodiment, the plastic building block is comprised of recycled plastic. In one embodiment, the plastic building block is configured to form a continuous wall of a structure. In one embodiment, the rectangular body is approximately 18" in length, 12" in height, and 5.5" in width. In another embodiment, the at least one locking channel is a pair of locking channels, wherein each locking channel of the pair of locking channels comprises a locking groove.

In another aspect of the invention, a plastic building block is provided, comprising a body having a top surface, a bottom surface, a first end, and a second end, wherein the first end and the second end are perpendicular such that the body forms an L-shape; a male connecting member positioned on the first end; a female connecting member positioned on the second end; at least one locking channel extending through the body from the top surface to the bottom surface; a locking groove positioned in the at least one locking channel, wherein the locking groove is configured to accept a portion of a locking member; and, the plastic building block is configured to join and connect with an adjacent plastic building block, wherein the adjacent plastic building block is configured to connect to the first end or second end via the male or female connection respectively, or alternatively above or below the plastic building block via the locking member.

In one embodiment, the L-shape is configured to be positioned in a corner of a structure.

In yet another aspect of the invention, a modular building block for constructing a continuous wall of a structure is provided, comprising a body having a top surface, a bottom surface, a first end, and a second end, wherein the first end and the second end are parallel or perpendicular such that the body is rectangular or L-shaped, respectively; a male connecting member positioned on the first end, wherein the male connecting member extends entirely from the top surface to the bottom surface; a female connecting member positioned on the second end, wherein the female connecting member extends entirely from the top surface to the bottom surface; the modular building block is configured to join and connect with an adjacent modular building block, wherein the adjacent modular building block is configured to connect to the first end or second end via the male or female connection respectively in a horizontal plane, or alternatively above or below the plastic building block in a vertical plane, wherein the modular building block and the adjacent modular building block are configured to lock together in the vertical plane; and, wherein the body is entirely comprised of recycled plastic.

In one embodiment, the body further comprises a pair of locking channels extending through the body from the top surface to the bottom surface, wherein each locking channel comprises a locking groove configured to receive a portion of a locking member, wherein the locking member is configured to lock the modular building block and the adjacent modular building block in the vertical plane via the adjacent locking grooves.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide plastic building blocks.

It is to be understood that the terminology used herein is for the purpose of describing particular embodiments only and is not intended to be limiting. The terms "a" or "an," as used herein, are defined to mean "at least one." The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanently. The term "providing" is defined herein in its broadest sense, e.g., bringing/coming into physical existence, making available, and/or supplying to someone or something, in whole or in multiple parts at once or over a period of time. As used herein, the terms "about," "generally," or "approximately," apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Figure 1:
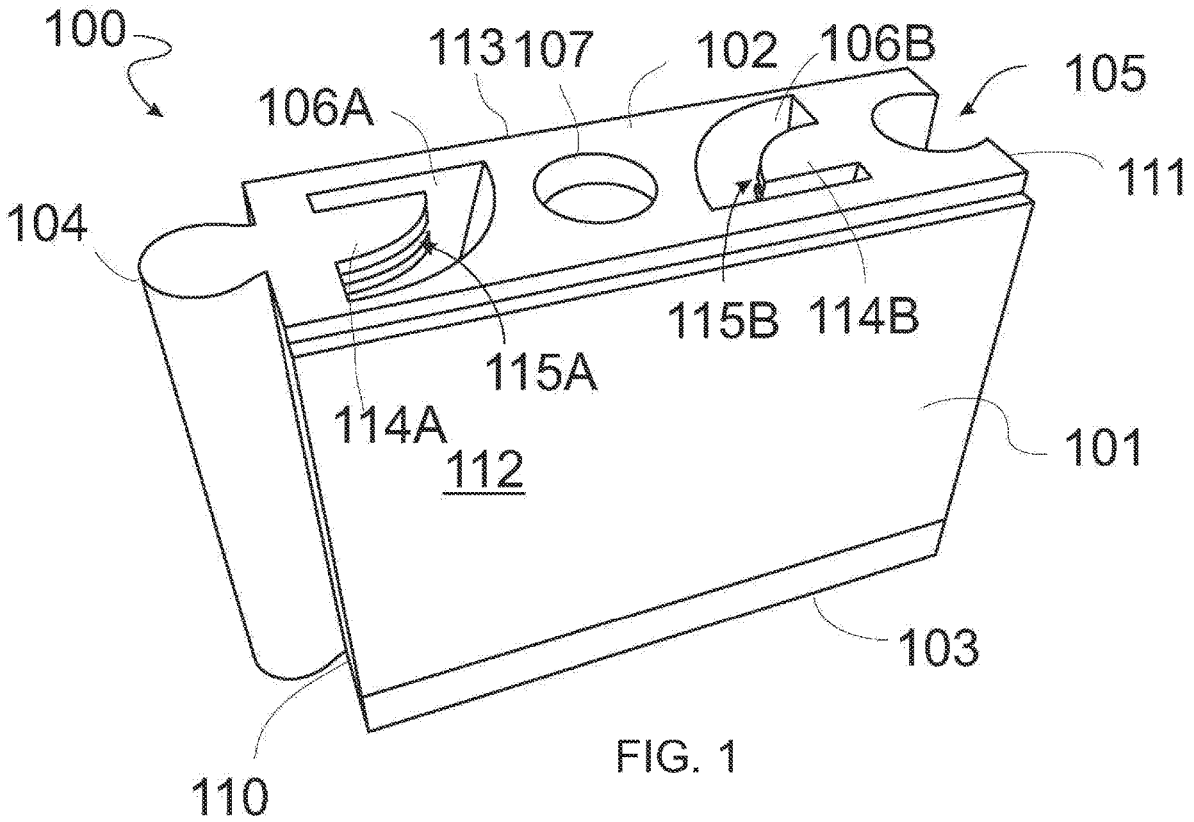
FIG. 1 is a perspective view of a plastic building block according to an embodiment of the present invention.
Figure 2:
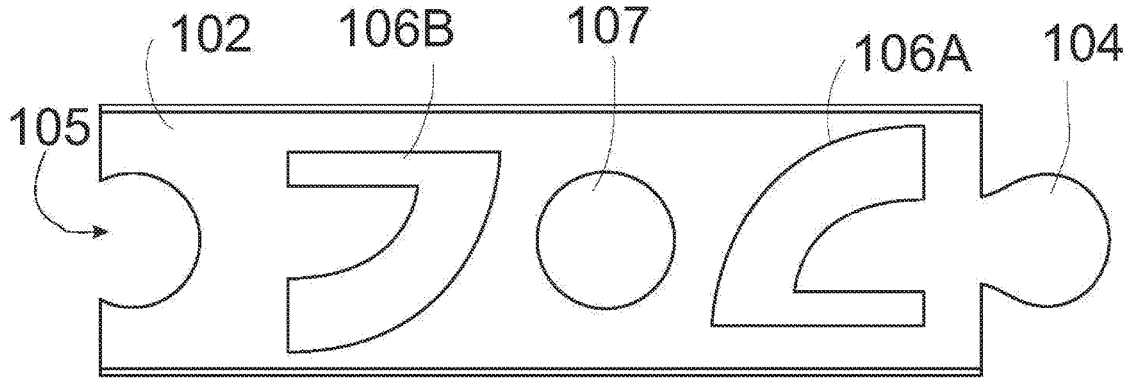
FIG. 2 is a top view of the plastic building block according to an embodiment of the present invention.
Figure 3A:
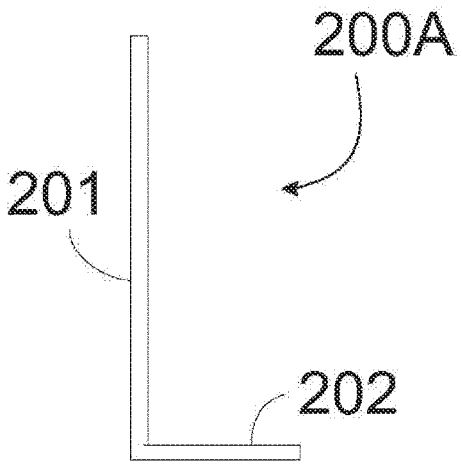
FIGS. 3A-B are side views of a locking member according to embodiments of the present invention.
Figure 3B:
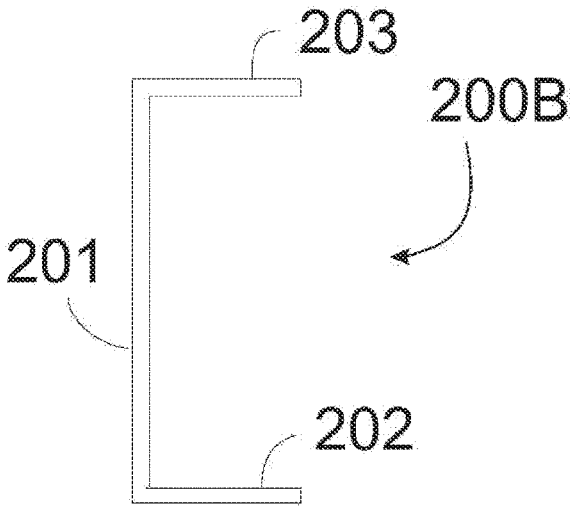

Referring now to either of the accompanying FIGS. 1-2, a plastic building block 100 is illustrated. In one embodiment, the plastic building block 100 comprises a rectangular body 101 having a top surface 102, a bottom surface 103, a left side 110, a right side 111, and a front and rear surface 112 and 113 respectively. Advantageously, each plastic building block 100 is configured to join and connect with an adjacent block to form a continuous wall of a structure. The adjacent block is configured to be left, right, above, or below the block, i.e. the plastic building block 100 is configured to attach to an adjacent block at a planer location to the first block, either horizontal and/or vertical. In one embodiment, a male connecting member 104 shaped as a protruding cylinder is provided on the left side 110 of the block and a similarly shaped female connecting member 105 or groove 105 is provided on the right side 111 of the block 100. This provides a tongue and groove method of attaching adjacent blocks together on a horizontal plane. It should be understood that the shape of the male connecting member or protruding element may vary as well as the female connecting member. The respective connecting members should be similarly shaped to enable a connection as well known in the art.

In one embodiment, a pair of locking channels 106A and 106B are provided, wherein the pair of locking channels extend entirely through the block from the top surface 102 to the bottom surface 103. In one embodiment, each locking channel 106A/106B comprises protruding material 114A/114B having a locking groove 115A/115B, wherein the protruding material is positioned approximate or in-line with the top surface 102 of the block 100. In some embodiments, the protruding material is comprised from the top surface. In some embodiments, the position of the protruding material provides the locking groove approximately 1 inch below the top surface.

Best seen in FIGS. 3A-4B, in some embodiments, the locking groove is configured to receive a locking member 200A/B. More specifically, in one embodiment, the locking groove is configured to receive a portion 202/203 of the locking member, wherein the locking member is L or U shaped, having a vertical portion 201 and one or two perpendicular locking portions 202/203. The perpendicular portion is configured to slide into the locking groove securing the locking member in place. In one embodiment, each locking channel of the pair of locking channels is comprised of a quarter circle shape enabling enough room to manipulate and configure the locking member. Ideally, this space should be minimized such that the volume of plastic used in the block is maximized, as it is a particular object of the present invention to provide a sturdy block capable of withstanding heavy winds and other environmental weather disasters.

Figure 9A:
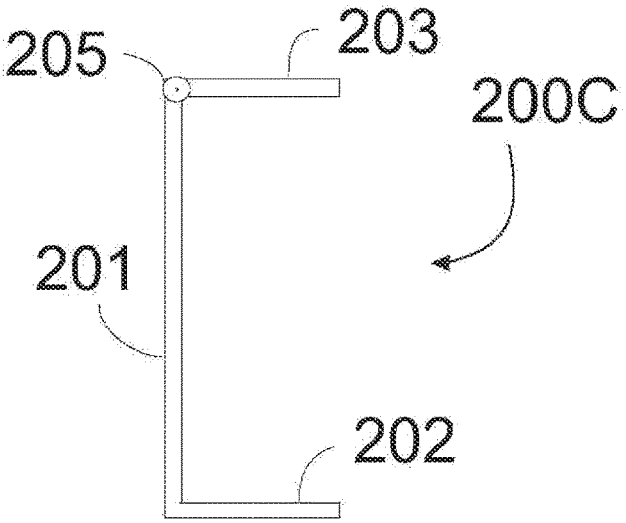
FIGS. 9A-B are side views of an alternative locking member according to embodiments of the present invention.
Figure 9B:
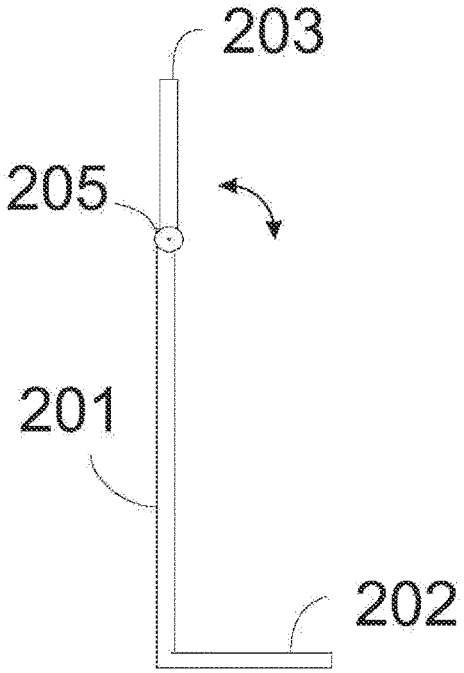

In one embodiment, a locking member 200B is configured to lock two adjacent vertical blocks together via locking portions 202/203 configured to engage the adjacent locking grooves of the respective blocks. Since there are two locking grooves per block, two locking members would be used securing the first block to the second block in a vertical position. During use, a user would use the locking channel to move and rotate the locking member 200B and respective locking portions in position within the adjacent locking grooves. This configuration enables a user to unlock the locking member by rotating the locking portions out of the locking grooves if desired. Advantageously, this enables the blocks to be reused if desired. In some embodiments, a hinge (205; FIGS. 9A-B) is provided enabling the locking portion 203 to rotate from perpendicular to parallel (90 degrees) relative to the vertical portion 201. This functionality helps the user install and position the locking member during use.

Figure 4A:
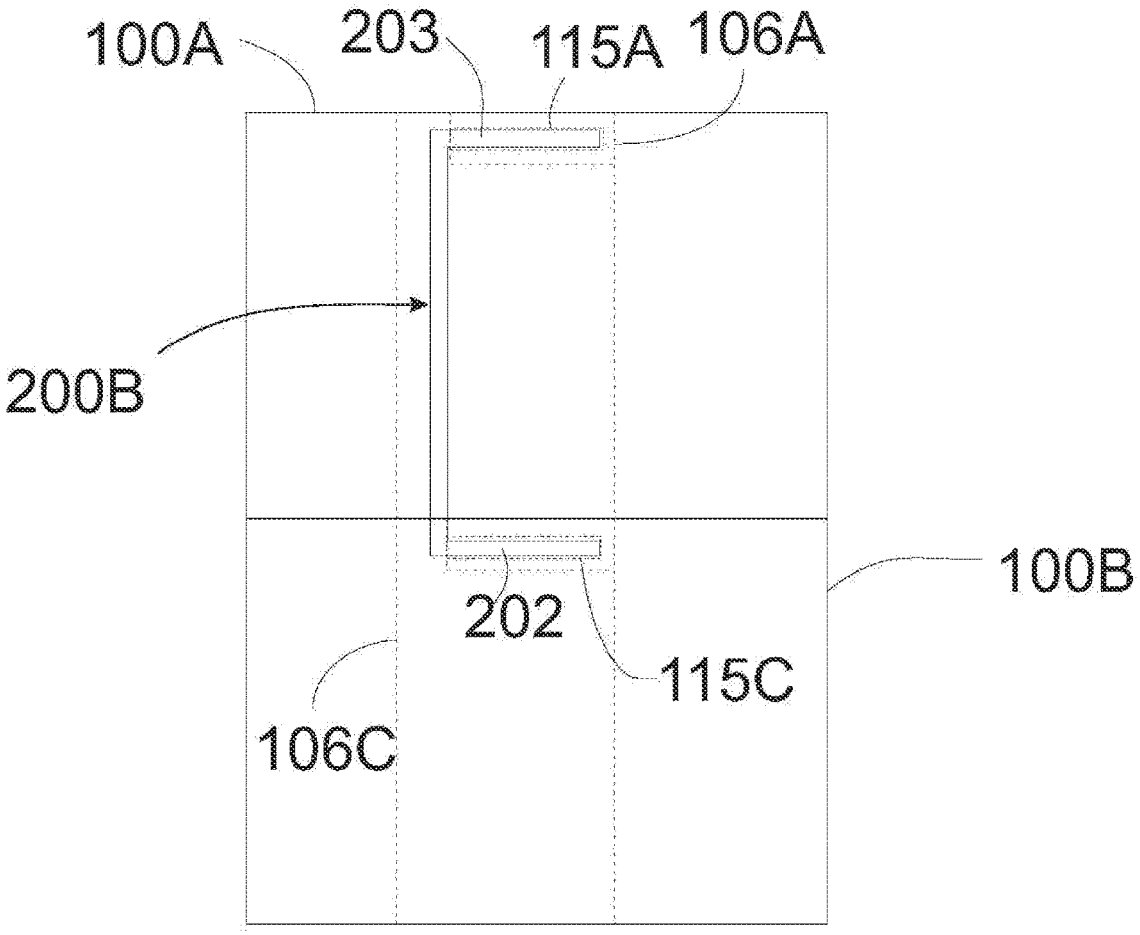
FIGS. 4A-B is a partial transparent side view of the plastic building block showing the locking channel and locking member locking to adjacent blocks in a vertical plane.

In an example, as shown in FIG. 4A, a locking member 200 having portions 203 and 202 positioned in two adjacent grooves 115A and 115C within locking channels 106A and 106B of two vertically aligned blocks 100A and 100B respectively is shown. It should be understood, that the size of the grooves may vary such that two locking members may fit in a single groove to allow for further stacking. In other embodiments, multiple grooves may be provided to allow for the stacking and locking of three or more blocks. It should be appreciated that one skilled in the art may utilize this concept to provide similar variations of the described method, and the following are merely provided examples.

Figure 4B:
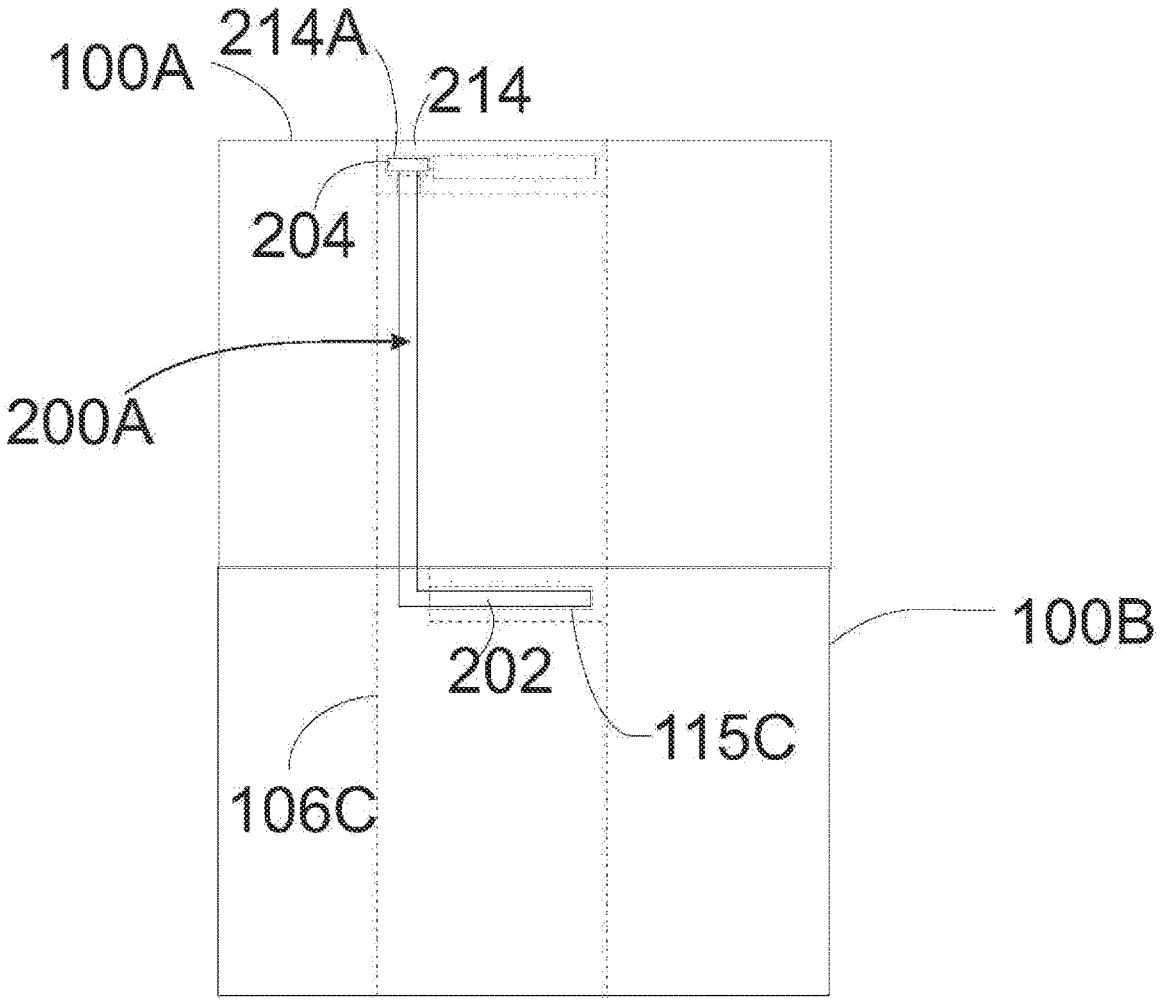
Figure 5A:
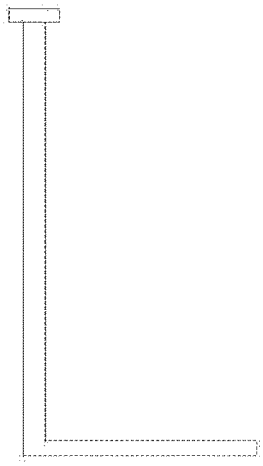
FIGS. 5A-B are side and front views respectively of an alternative locking member according to embodiments of the present invention.
Figure 5B:
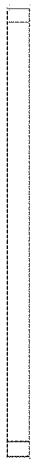

In an alternative embodiment, as shown in FIG. 4B, an alternative locking member 200A is configured to lock into an adjacent block's 110B locking groove 115C, wherein the free end of the locking member is either retained within the primary block 100A such as in the material 214 in the protruding material surface or top surface, or secured via additional material, e.g. a bonding material such as concrete or plastic concrete aggregate filled in the locking channel after the locking member is in the locked position. In embodiments, where the free end of the locking member is secured within material 214, a nub 204 may be provided on the free end enabling the locking member to be secured within a hollow area of the material 214A. This version of the locking member is shown in FIGS. 5A-B. It should be understood that these are two exemplary instances of locking two adjacent blocks vertically, and other methods and techniques may be used, including but not limited to latches and similar locking methods, as well as bonding agents, such as epoxy, mortar, glues, etc.

Figure 6:
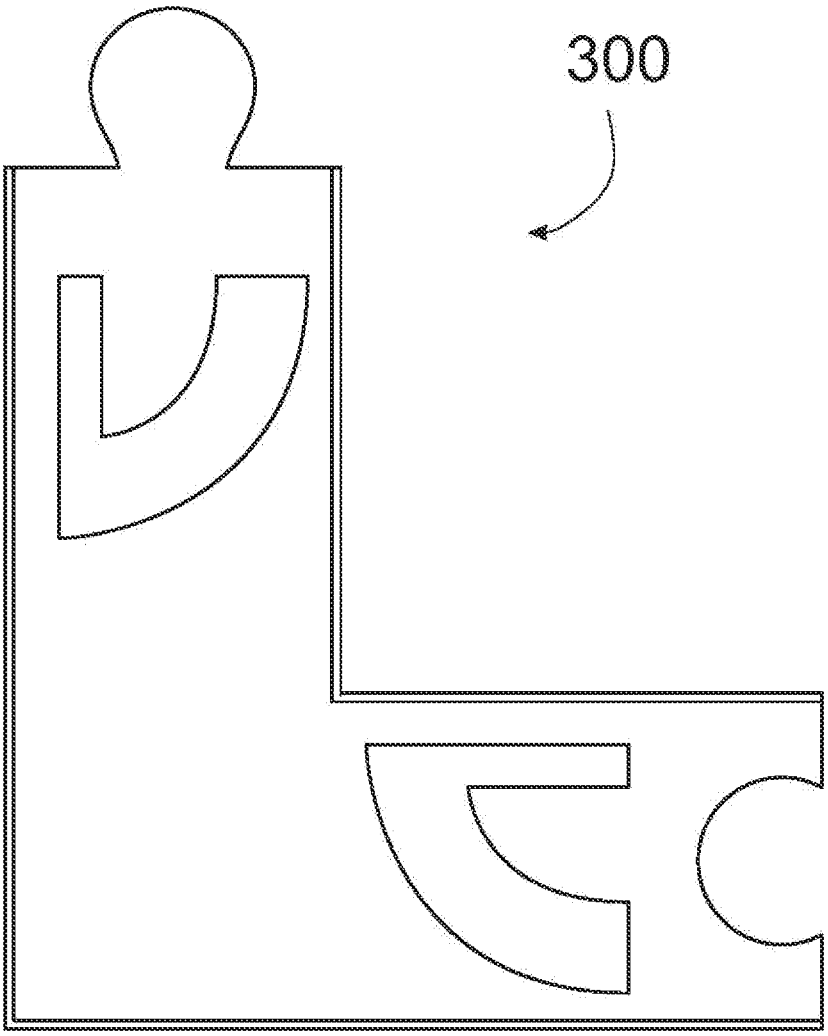
FIG. 6 is a top view of an L-shaped plastic building block according to an embodiment of the present invention.
Figure 7:
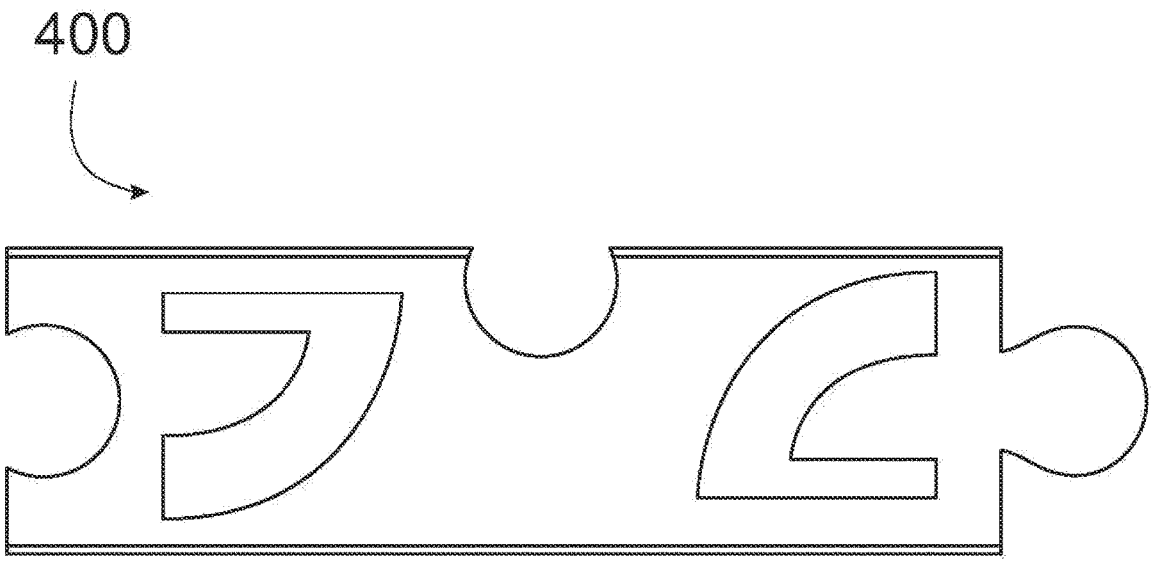
FIGS. 7-8 are top views of an alternative plastic building block having perpendicular connection members according to an embodiment of the present invention.
Figure 8:
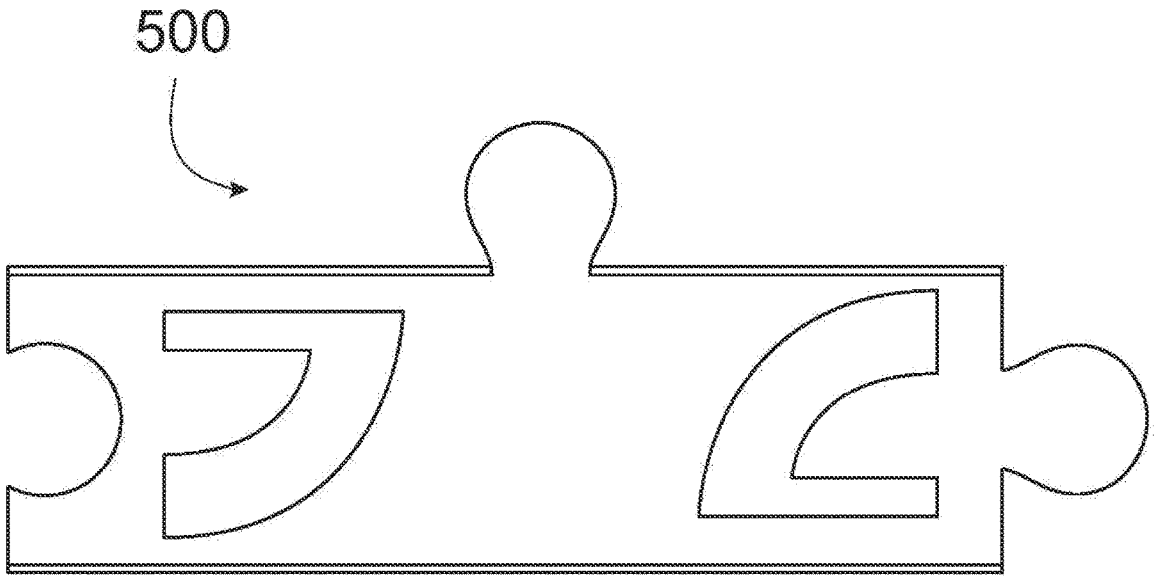

Although the size may vary, in one embodiment, the rectangular block is approximately 18" in length, 12" in height, and 5.5" in width. In other embodiments, different shaped blocks may be used to complete the building structure formation. For example, an L-shaped block 300 (best seen in FIG. 6) may be used on a corner location of a wall of the building structure. In this example, the protrusion and groove location may be positioned as needed. Similarly, a variation of the rectangular shaped block may be provided when joining interior walls as seen in blocks 400 and 500 in FIGS. 7 and 8 respectively. In these examples, the blocks may include protrusions or grooves to connect with blocks that are aligned perpendicularly.

Best seen in FIGS. 1-2, in some embodiments, the plastic building block 100 comprises a conduit 107 enabling electrical wires and/or plumbing to be fed through one or more connected vertical blocks. Although not illustrated, blocks 300, 400, and 500 may also include a conduit configured to retain electrical and/or plumbing connections. Once installed, holes, cutouts etc. may be drilled, cut, or fabricated such that the electrical and/or plumbing connections may be accessed. Likewise, any traditional building techniques, including not limited to, insulation, drywall, switches, outlets, painting, etc. may be used with the blocks of the present invention. However, due to the construction of the dense plastic construction of the blocks, the blocks naturally provide effective insulation and are configured to be used and provide the exterior and interior of a building structure. The construction of the blocks will be discussed in further details below.

The plastic building blocks of the present invention may be used for the construction of any building or structure, including single story homes, multiple family units, multi-story homes and structures, offices, commercial spaces, bridges, walls, sporting complexes, or other building structures. Further, they can be combined or integrated with other stick-built, brick, concrete, or modular structures.

In some embodiments, the plastic building block is entirely constructed from recycled plastic. In one embodiment, each block is formed via injection molding. In another embodiment, each block is formed via casting. The constructed process may be in one or more parts that are bonded together. In another embodiment, the plastic building block is constructed via 3D printing. In some embodiments, a combination of techniques may be used. For example, the shell or outer surface area of the building block may be made via a mold, wherein the remaining area can be filled with melted plastic, which when cooled is configured to form the plastic building block described herein. Preferably, the plastic building block is formed of dense plastic with minimal hollow spaces as needed, such as the locking channels and the conduit, allowing the block to provide a sturdy building base having effective insulation properties.

Figure 10:
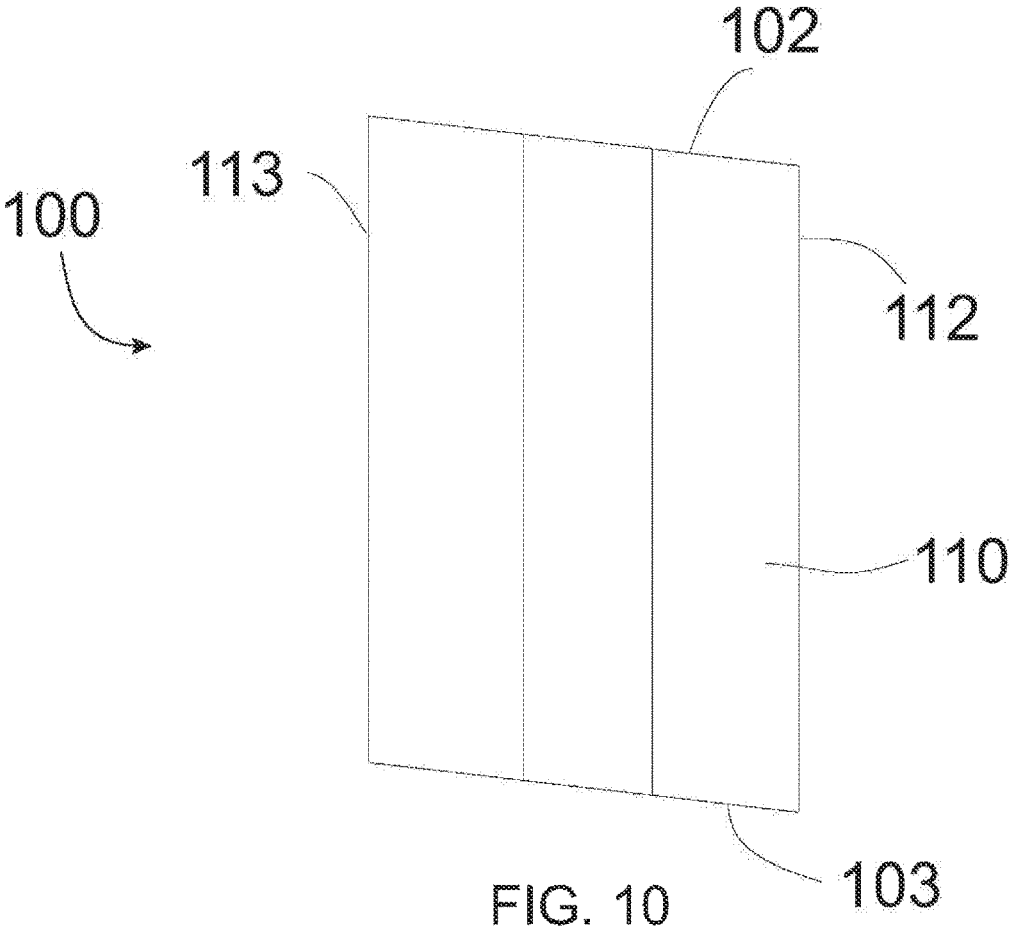
FIG. 10 is a side view of a plastic building block according to an embodiment of the present invention.

Best seen in FIG. 10, in some embodiments, the top surface 102 of the plastic building block 100 is sloped from the rear side 113 to the front side 112, wherein the slope facilitates water runoff. In these embodiments, the bottom surface 103 is also sloped such that when vertically stacking blocks, the adjoining surfaces are flush.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For example, although not illustrated the conduit 107 may include horizontal passageways running lengthwise throughout the plastic building block such that electrical and plumbing connections may traverse horizontally through the structure if needed.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A plastic building block comprising:

a rectangular body having a top surface, a bottom surface, a left side, a right side, a front surface, and a rear surface;

a male connecting member positioned on the left side and extending entirely from the top surface to the bottom surface of the rectangular body;

a female connecting member positioned on the right side and extending entirely from the top surface to the bottom surface of the rectangular body;

at least one locking channel extending entirely through the rectangular body from the top surface to the bottom surface;

an arcuate locking groove positioned in a protruding wall of the at least one locking channel, the protruding wall located and extending below the top surface of the rectangular body, wherein the locking groove is configured to receive a portion of a locking member; and, the plastic building block is configured to join and connect with an adjacent plastic building block, wherein the adjacent plastic building block is configured to connect to the left side or right side via the male or female connecting member respectively, or alternatively above or below the plastic building block via the locking member.

2. The plastic building block of claim 1, further comprising a conduit extending entirely through the rectangular body from the top surface to the bottom surface, wherein the conduit is configured to enable electrical and plumbing connections to pass through the rectangular body.

3. The plastic building block of claim 1, wherein the top surface and the bottom surface is sloped from the rear side to the front side, wherein the sloped top surface is to facilitate water runoff.

4. The plastic building block of claim 1, wherein the front surface or rear surface includes an additional male or female connecting member configured to allow the adjacent plastic building block to connect perpendicularly to the rectangular body.

5. The plastic building block of claim 1, wherein the plastic building is entirely comprised recycled plastic.

6. The plastic building block of claim 1, wherein the rectangular body is approximately 18 inches in length, 12 inches in height, and 5.5 inches in width.

7. The plastic building block of claim 1, wherein the at least one locking channel is a pair of locking channels, wherein each locking channel of the pair of locking channels comprises a respective said arcuate locking groove.

8. The plastic building block of claim 1, wherein the male connecting member is a cylindrical protrusion.

9. The plastic building block of claim 8, wherein the female connecting member is a cylindrical groove configured to match the size and shape of the cylindrical protrusion.

10. A plastic building block comprising:

a body having a top surface, a bottom surface, a first end, and a second end, wherein the first end and the second end are perpendicular such that the body forms an L-shape;

a male connecting member positioned on the first end and extending entirely from the top surface to the bottom surface of the body;

a female connecting member positioned on the second end and extending entirely from the top surface to the bottom surface of the body;

at least one locking channel extending through the body from the top surface to the bottom surface;

an arcuate locking groove positioned in a protruding wall of the at least one locking channel, the protruding wall located and extending below the top surface of the body, wherein the locking groove is configured to receive a portion of a locking member; and, the plastic building block is configured to join and connect with an adjacent plastic building block, wherein the adjacent plastic building block is configured to connect to the first end or second end via the male or female connecting member respectively, or alternatively above or below the plastic building block via the locking member.

11. The plastic building block of claim 10, wherein the plastic building block is comprised of recycled plastic.

12. The plastic building block of claim 10, wherein the L-shape is configured to be positioned in a corner of a structure.

13. The plastic building block of claim 12, wherein the male connecting member is a cylindrical protrusion.

14. The plastic building block of claim 13, wherein the female connecting member is a cylindrical groove configured to match the size and shape of the cylindrical protrusion.

15. A modular building block for constructing a continuous wall of a structure comprising:

a body having a top surface, a bottom surface, a first end, and a second end, wherein the first end and the second end are parallel or perpendicular such that the body is rectangular or L-shaped respectively;

a male connecting member positioned on the first end, wherein the male connecting member extends entirely from the top surface to the bottom surface;

a female connecting member positioned on the second end, wherein the female connecting member extends entirely from the top surface to the bottom surface;

at least one locking channel extending through the body from the top surface to the bottom surface;

an arcuate locking groove positioned in a protruding wall of the at least one locking channel, the protruding wall located and extending below the top surface of the rectangular body, wherein the locking groove is configured to receive a portion of a locking member;

the modular building block is configured to join and connect with an adjacent modular building block, wherein the adjacent modular building block is configured to connect to the first end or second end via the male or female connecting member respectively in a horizontal plane, or alternatively above or below the plastic building block in a vertical plane, wherein the modular building block and the adjacent modular building block are configured to lock together in the vertical plane; and, wherein the body is entirely comprised of recycled plastic.

16. The modular building block of claim 15, wherein the at least one locking channel comprises a pair of locking channels extending through the body from the top surface to the bottom surface, wherein each locking channel comprises a respective said arcuate locking groove configured to receive the portion of the locking member, wherein the locking member is configured to lock the modular building block and the adjacent modular building block in the vertical plane via adjacent said locking grooves.

* * * * *